US008708772B2

(12) United States Patent
Fernandez Cuevas

(10) Patent No.: US 8,708,772 B2
(45) Date of Patent: Apr. 29, 2014

(54) BRASSIERE FOR SLEEPING FOR THE PREVENTION AND CORRECTION OF SAGGING BREASTS AND WRINKLES

(76) Inventor: Marta Maria Fernandez Cuevas, Madrid (ES)

( * ) Notice: Subject to any disclaimer, the term of this patent is extended or adjusted under 35 U.S.C. 154(b) by 42 days.

(21) Appl. No.: 13/512,203

(22) PCT Filed: Nov. 30, 2010

(86) PCT No.: PCT/ES2010/000484

§ 371 (c)(1),
(2), (4) Date: May 25, 2012

(87) PCT Pub. No.: WO2011/067433

PCT Pub. Date: Jun. 9, 2011

(65) Prior Publication Data

US 2012/0270473 A1 Oct. 25, 2012

(30) Foreign Application Priority Data

Dec. 1, 2009 (ES) ..... 200930717 U
Nov. 25, 2010 (ES) ..... 201031186 U

(51) Int. Cl.
*A41C 3/00* (2006.01)
*A41C 3/14* (2006.01)

(52) U.S. Cl.
CPC ..... *A41C 3/0057* (2013.01); *A41C 3/144* (2013.01); *A41C 3/148* (2013.01)
USPC ..... 450/57; 450/54; 2/267

(58) Field of Classification Search
USPC ..... 450/38, 54–57, 1; 2/267, 268
See application file for complete search history.

(56) References Cited

U.S. PATENT DOCUMENTS

| | | | | |
|---|---|---|---|---|
| 1,466,598 | A | 8/1923 | Panes | |
| 2,478,103 | A | 8/1949 | Lillian | |
| 5,221,227 | A * | 6/1993 | Michels | 450/1 |
| 5,807,160 | A * | 9/1998 | Wehmeyer | 450/57 |
| 6,769,955 | B1 * | 8/2004 | Fisher | 450/54 |

FOREIGN PATENT DOCUMENTS

| | | |
|---|---|---|
| CA | 2575534 | 12/2008 |
| ES | 1035527 | 1/1997 |
| ES | 1034899 | 2/1997 |
| FR | 2752146 | 2/1998 |

OTHER PUBLICATIONS

International Search Report of PCT International Publication No. WO 2011/067433.
International Preliminary Report on Patentability of PCT Application No. PCT/ES2010/000484.

* cited by examiner

*Primary Examiner* — Gloria Hale
(74) *Attorney, Agent, or Firm* — Phillips Lytle LLP

(57) ABSTRACT

A brassiere consisting of an integral body having a front portion, and a rear portion as a lateral extension of the front portion. The edge considered to be the lower edge, of the front portion as well as of the rear portion, has an elastic band which supports the entire structure of the brassiere. The center of the elastic band extends into an ascending sector defining a bridge having concave lateral edges and a lower edge which is also curved-concave, while the tops of the lateral edges also have divergent sections suitable for adapting to the contour of the breasts of the user. The bridge has cushioned padding, which affects the intermammary area up to the neckline as well as the semi-perimeter of the lower contour of the breasts including the lateral portions or sides of the armholes.

7 Claims, 5 Drawing Sheets

A-B

C-D

BRASSIERE FOR SLEEPING FOR THE PREVENTION AND CORRECTION OF SAGGING BREASTS AND WRINKLES

CROSS-REFERENCE TO RELATED APPLICATION

The present application claims priority benefit as a 371 of International Application No. PCT/ES2010/000484, filed on Nov. 30, 2010, which claims priority of a) Spanish Utility Model No. U200930717 filed Dec. 1, 2009, and (b) Spanish Utility Model No. U201031186filed Nov. 25, 2010.

OBJECT OF THE INVENTION

The present invention relates to a brassiere for sleeping for the correction of sagging breasts and wrinkles, whose evident purpose is to provide rest for the breasts, as well as preventing and correcting breast sagging by restraint, preventing the skin from distending and losing consistency and elasticity. It is also the object of the invention to prevent and correct the appearance of wrinkles and "memory lines" in the whole area of the neckline and chest, understanding by "memory lines" those that are repeated day after day in the same places or areas, due to continuous repetition of postures and movements.

The brassier is indicated for use in periods of sleeping, rest and repose, during the practice of sports or other activities that require an extra physical effort, its use being also recommended after breast surgery, during pregnancy and for people subjected to severe weight changes.

The brassiere is further complemented by an inter pectoral pad for use in specific therapeutic activities, in addition to its use along with the brassiere in periods of sleep, rest, repose and practicing sports.

BACKGROUND OF THE INVENTION

Brassieres that are used during the day contain excessive seams and material, such as wires and other elements that subject breasts to an excessive pressure, as well as to an inadequate support. Breasts have to be well adapted to the brassiere, they cannot remain loose since this can cause inconveniences and problems, such as hardness, uncomfortable marks and chest and back pain.

The skin deterioration that is produced by natural causes presents itself in the shape of wrinkles, furrows or lines of expression, so that these are normally caused by muscular contraction, being accentuated in greater measure in areas where movements or postures are repeated frequently.

Physical deterioration is due to the loss of three important elements for the skin: collagen, elastin and glycosaminoglycans responsible for retaining and maintaining the moisture content in the skin. Among other causes that will accelerate the process, the abuse of sunbathing, tobacco, alcohol and pollution that block the pores, reducing the possibility of the skin to conveniently oxygenate; drastic changes in weight, pregnancy, and plastic surgery, where the skin and volume are subjected to drastic changes, should also be noted.

Therefore, breasts due to their volume and weight tend, when they are not being supported by any type of garment, to move and slide one on another, or they move toward the sides, so that the weight of the breast applies a constant pressure in their connecting area which corresponds to the intermammary area, where they apply all their weight upon falling one on another. When this happens, the breasts drag, tighten and pull the skin that holds them, which is located in the area of the neckline (their only support) from the base of the neck, causing wrinkles and lines of expression. The dragging caused by the weight of the breasts causes stretching of the skin and, as a result, breasts lose firmness and begin to drop and sag, producing the opposite effect when the breasts are moving toward the sides for lack of support, causing the stretching of the skin from the intermammary central area, where the breasts start to take shape.

That is to say, breasts, due to their weight, volume, bad postures, use of improper garments, pregnancies, surgeries, severe diets that cause aggressive changes in weight and the passage of time itself, involve a loss of firmness in the skin and, as consequence, cause sagging of the breast.

However, there are bra designs that aim to prevent the formation of wrinkles in the neckline, designs that are often made from Lycra, lacking cups or other support for the breasts, the design consists of a strapless bra without cups, which remains close to the skin in the intermammary area, keeping the breasts separated, but creating a void in the area, which does not prevent the sliding of the breasts on one another while sleeping or resting, as they are dragged by their own weight and volume. In the absence of any cups or any other system that holds the breasts, wrinkles in the central area of the neckline are prevented, as the sliding of the breasts when in an extended or lying down position cannot be avoided, which causes the skin of the breasts to stretch, losing consistency and they end up sagging by pulling the skin in connection to the upper area of the breast, so the lateral areas of the neckline remain unprotected. Besides, the surface of the skin that has not been protected in the lateral area, ends up dragging the central area, or the lateral area stretches so much that upon being the central area smooth and the lateral area stretched, it causes vertical lines in the bust's line where it joins the arms, an effect that is appreciated the grater the volume of the breasts. That is, the greater the volume and weight, the greater the pressure and the dragging.

Another disadvantage of bra designs provided for the previously mentioned purposes, is that they are "one size fits all", so they are not suitable for people with a considerable volume, thereby limiting their suitability to sizes of small volume or to those who have not suffered from the influence of any physical or external agent.

There are also bra designs that aim for the same purpose, based on introducing a type of padded structure with an oval, narrow shape between the two breasts, so that the disadvantage of this model or design is that it only prevents the formation of wrinkles in the intersection of the breasts, since it does not extend toward the neckline, with the added drawback that the breasts remain under an excessive pressure, disturbing rest and leaving the neckline skin unprotected.

DESCRIPTION OF THE INVENTION

The brassiere that is being recommended has been created to solve all those problems, based on a special design or configuration. More specifically, the brassiere of the invention is an integral body with two well differentiated parts, a front portion and a rear portion, as a lateral extension of the front portion, the latter having a lower elastic band on its entire length, the centre of the elastic band extends into an ascending sector having concave lateral edges, these having a progressive divergence upwards, until reaching the shoulder area, where it will be hooked to shoulder straps emerging from the rear portion of the bra, when placing and fastening it for its application or use. The ascending sector that emerges centrally from the lower elastic band will be hereinafter called "bridge".

On the other hand, the above-mentioned lower elastic band, which in addition is the support means of all the integral body, has edges that project upwards, with a slight divergence, forming the sides of the corresponding armholes, with inner concave curvature to form the corresponding cups for the breasts with the curved lateral edges of the bridge.

As for the rear portion of the bra, besides the fastening elements on the lateral of the opposite side, it has padded, elastic straps with adjusting means to adapt its length.

Going back to the front portion of the bra, it includes padding that fills the void areas when wearing the bra, areas that correspond to the intermammary, i.e. the lower area of the bridge, acting as support for the breasts, as well as the areas of the semi-perimeter of the contour of the breasts themselves, to keep them separated and to avoid using the typical wire. This padding is reduced in thickness as it approaches the neckline, as well as in its projection toward the lateral of the semi-perimeter of the lower contour of the breasts.

The lateral extension that determines the rear portion of the bra, will derived preferably from the left side or lateral, to close and fasten on the right side, the bra being put on through the head. Undoubtedly the way of fastening and wearing the bra can be resolved in many other ways, provided that they turn out to be feasible, simple and comfortable for the user.

Regarding the lateral concave edges of the portion considered as the bridge and their lateral extensions or sides, they have a quilted padding which purpose is to fill the areas that generate a void around the contour of the breasts, providing optimum support and comfort for the breasts.

The bra is complemented with inner lining made of microfiber, Lycra or the like, which covers both the front and the rear portions, being set around the perimeter by sawing it or by any other system to properly attach it.

According to the design that is provided by the above-mentioned characteristics, the bra itself turns out to be suitable for all kinds of women, regardless of the volume and contour of their breasts, being able to be manufactured in all kinds of sizes, small, medium or large.

Another of the advantages of the bra is that it allows sleeping on your stomach diminishing the pressure that the body exerts on the breasts, since the void produced in the intermammary area has been filled.

Also say that wearing said bra prevents the skin from stretching, holding the weight of the breasts so that these remain in their natural position, thereby preventing the weakening of the skin and ultimately preventing and delaying the formation of wrinkles that generate in the entire neckline and thoracic area, the only and main support of the breasts, besides preventing and correcting the lines and wrinkles in the intermammary area.

Said bra is susceptible to be complemented with an inter-pectoral pad to fill all the voids that generate in the thorax and pectoral areas which generate movement, sliding or pressure on the breasts, keeping them in their natural position, since it fills and does not separate.

Specifically, that inter-pectoral pad, as a complement of the bra, is formed by a moulded body made of foam or other similar spongy material, that gives it the adequate comfort, so that said pad offers a relatively flat frontal face, although with a notably curved-convex profile and with short lateral extensions in its edges, while its rear or inner face configures a sharp, rounded ridge crest and curved-concave faces, being said crest intended to lean on the user's thorax, while its curved-concave lateral edges perfectly adapt to the breasts, protecting them when the pad lays through its frontal face on a horizontal surface such as a mattress, bed, or any another surface.

Said spongy body of the pad will be conveniently covered by a lining made of microfiber, Lycra or the like, that covers it entirely and gives it an appropriate surface feel.

Evidently, although the above-mentioned inter-pectoral ad is expected to be used jointly with the brassiere for sleeping for the prevention and correction of sagging breasts and wrinkles, described above, it could also be used alone, in which case it could be equipped with fixing means of its own which allows using it while standing, seated or walking, being those fixing means formed by, for example, shoulder straps with removable fasteners to attach them to the above mentioned ends or edges of the pad's body.

DESCRIPTION OF THE DRAWINGS

To complement the description being made and in order to help better understand the features of the invention, according to a preferred practical embodiment thereof, a set of drawings is attached as an integral part of said description, wherein the following is shown as way of illustration but not limited to.

PREFERRED EMBODIMENT OF THE INVENTION

Figure 1:
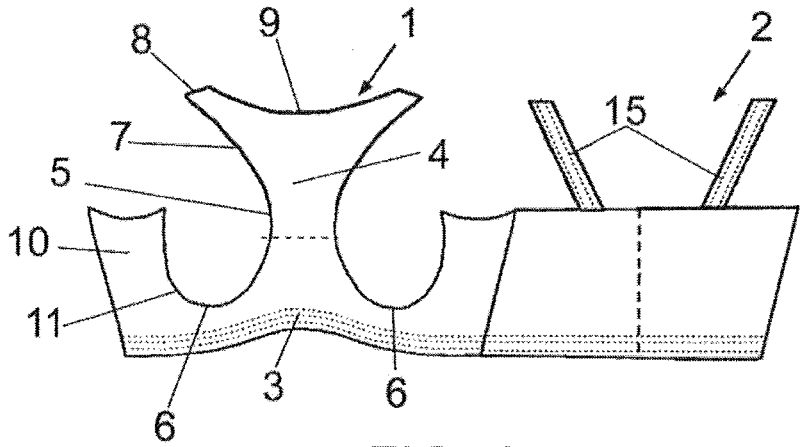
FIG. 1 Shows a front overall view of the brassiere of the invention, in an unfolded position.

In the above-mentioned figures the bra of the invention is shown comprising a front portion (1) and a rear portion (2), forming an integral body, wherein the front portion (1) includes a lower elastic band (3) as a support for the whole structure, extending along said front portion (1).

From this lower elastic band (3) an ascending sector centrally derives, determining the so-called bridge (4), with its concave lateral edges (5) projecting downwards on one side, determining a lower concave edge (6), and projecting upwards on the other side, with divergent sections (7). Said bridge (4) extends to the upper portion corresponding to the shoulder area (8), establishing, between the edges or shoulders themselves, the upper edge of the neckline (9).

Besides, the central area of said lower elastic band (3) is extended toward the lateral sides, and at the same time extends on the sides (10) of the armholes, on which sides (10), the concave curvature (11) of its inner and lower edge (6) is extended, determining, among the above-mentioned concave edges (5, 6 and 11), the cups (13) of the bra.

Figure 2:
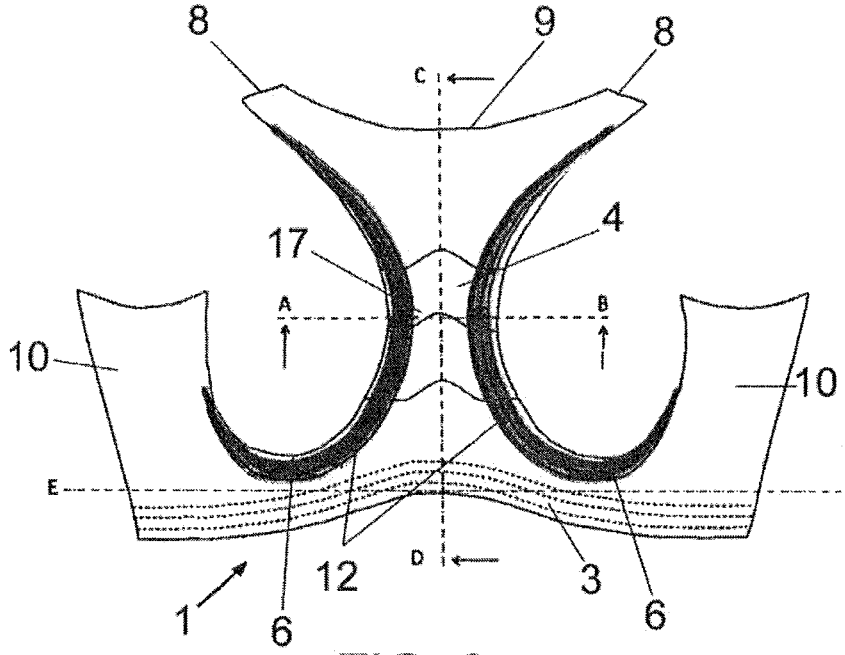
FIG. 2 Shows a view of the inner face of the bra's front portion, with respect to line E which corresponds to the measurement of the thorax.

In turn, the bridge (4) has a cushioned padding (12) that covers both the inter-mammary area up to the neckline, and the semi perimeter of the lower contour of the breasts (14), including the sides (10) of the armholes, the padding also covers the rear portion, the lower elastic band (3) and the inner semi-circle of the breast, as shown in FIG. 2.

Said cushioned padding (12) gradually reduces its thickness toward the neckline, and at the same time, it reduces its width toward the corresponding part of each concave edge (6) of each cup (13) toward the corresponding portion or side (10).

In the aforementioned FIG. 2), point (17) is shown as the point where the internal development of the breast is located, which is the measure that indicates the depth existing between the imaginary horizontal line that brings both breasts together from their edges and up to the sternum point. This depth allows calculating the corresponding padding in that area for each size.

Figure 3:
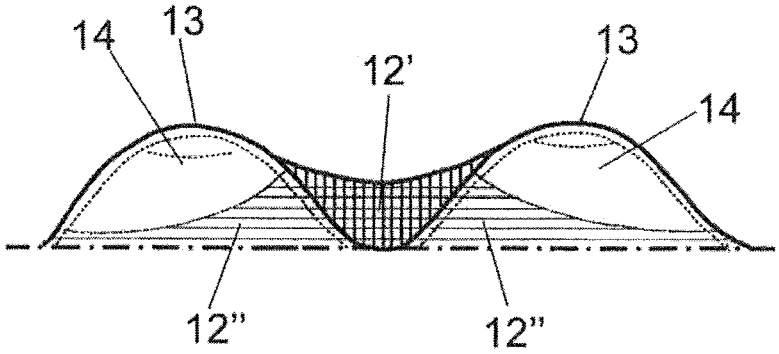
FIG. 3 Shows a section view corresponding to cut line A-B represented in the figure above.
Figure 4:
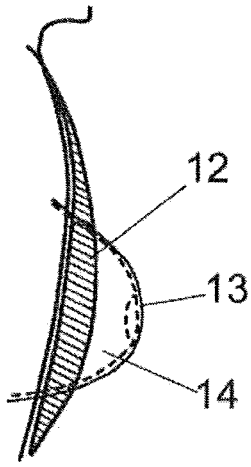
FIG. 4 Shows a section view corresponding to cut line C-D represented in FIG. 3.

As for the padding (12') of the inter-mammary area, just as shown in FIG. 3, it takes the shape, in an ascending way, of the breasts (14), adapting and surrounding the contour of their area, filling and holding the void that is created between them, respecting their natural shape.

Said FIG. 3 shows how the cushioned padding (12") extends toward the semicircle of the lower part, the base of the breasts (14), avoiding the use of conventional wires or other pieces of support that are so uncomfortable.

Regarding the padding of the bridge (4), note that it will be applied both in the inter-mammary area and on the sides of the armholes as well as in the rear portion itself and the contour of the breasts, depending on the size in question.

In regards to the cups (13), formed in the bra, its function is to avoid the movement of the breasts and protect them against rubbing and stretching in areas where the central support section does not cover them, these cups (13) join and integrate in the support or central section, thus avoiding unnecessary seams, with the particularity that the external contour of said cup (13) is reduced proportionally to the padding that has been used in the semicircle of the breast (14) in which the padding itself has been used both in the intermammary central area and in the lower part of the breast itself.

On the other hand, the rear portion (2), which is significantly rectangular as it can be seen in FIG. 1, has a fastener on a side (10), the opposite side from the one that derives from said rear portion (2), so that placing the seam on a side, facilitates putting the bra on, especially for people who, due to the volume of their breast contour, have limited mobility.

Figure 5:
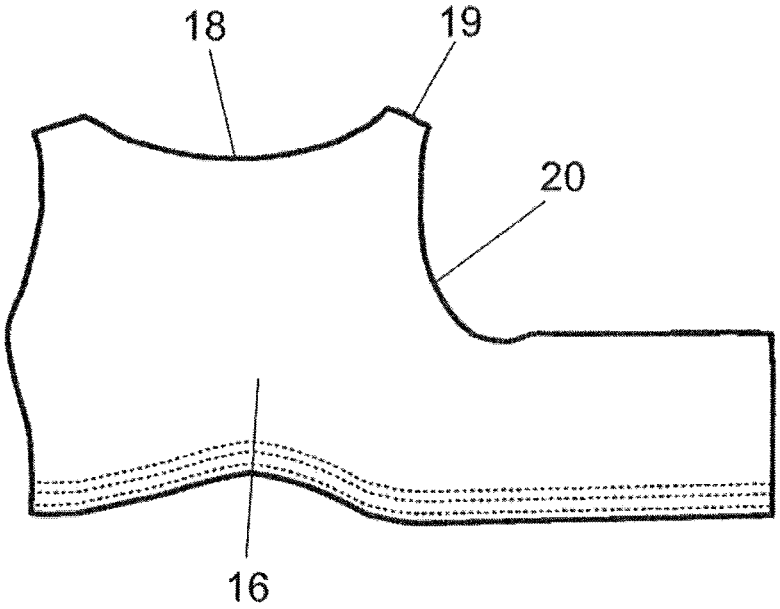
FIG. 5 Shows a view corresponding to the development of the piece that makes up the lining of the bra represented in the previous figures.
Figure 6:
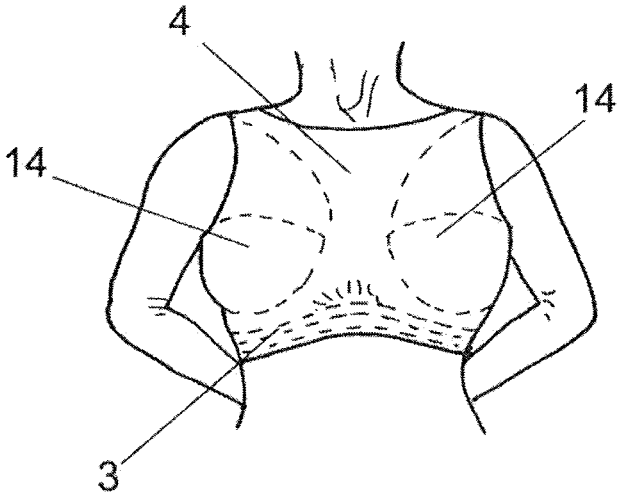
FIG. 6 Shows a front schematic view of the bra when it is being applied or worn.
Figure 7:
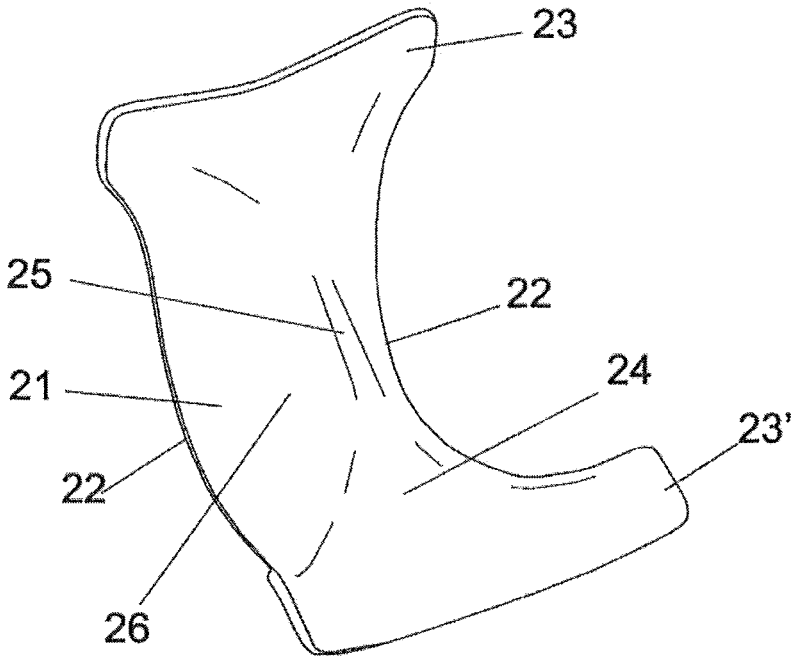
FIG. 7 Shows a lateral-rear or inner perspective view of the inter-pectoral pad carried out in accordance with the object of the present invention.
Figure 8:
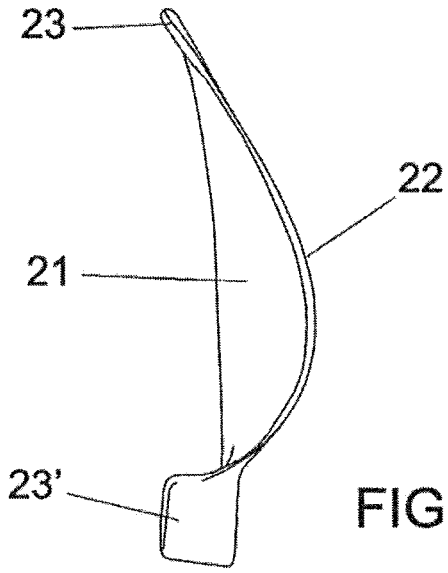
FIG. 8 Shows a profile view of the same pad represented in the previous figure displaying, in a dotted line, the complementary shoulder straps of selective use.

That rear portion (2) of the bra includes shoulder straps (15) which are padded and adjustable, being fastened on the front, as well as lining (16) that protects the bra and has been represented on its own in FIG. 5, those shoulder straps (15) are fixed to the contour line of the back, so that, in any case, the shoulder straps can be used in a X or line pattern, depending on the user's preference, with their position being located from the acromion bone toward the interior, in the direction of the base of the neck, so that upon being placed over a bone, unnecessary pressure on the skin is avoided.

As previously mentioned, the structure of the bra is protected with a lightweight cover or lining (16) made of microfiber, Lycra or the like, which gives the bra its final shape, protecting the armholes area and preventing the formation of vertical wrinkles running parallel to the armholes and the ones generated in the neckline.

FIG. 5 shows the neckline (18) of the lining (16) on the line of the collarbone, as well as point (19) which corresponds to the acromion bone's placement, this point is where the shoulder strap lays, following the shoulder's line toward the base of the neck, the curved lateral section (20) being indicated by the armhole line.

With the previously described brassiere, all the areas susceptible of generating wrinkles are isolated upon filling the void that is created in the thoracic area, inter-mammary area and contour of the breasts, independently isolating all the areas that may generate them, the breasts are protected and the stretching of the skin and sagging of the breasts is avoided, thanks to the holding effect of all its perimeter, which is logically carried out by the cups of the bra itself, leaving the area corresponding to thoracic cage and neckline protected by the ascending and central sectors considered as a bridge (4), while the sides (10) are padded and encircling, preventing the breasts (14) from getting out of the cups (13) of the bra itself.

On the other hand, it can be said that the incorporation of the cushioned padding of the bra in all the void areas, acts as a retaining wall to avoid the formation of wrinkles, even when keeping the same position all night, helping to keep skin firm and smooth, and providing the necessary rest for the breasts, as the structure works as a pillow.

Also notable is the fact that, whatever the position in which the user sleeps, the breasts and skin remain protected with the maximum comfort, creating a pleasant sensation of well-being, so that referring to the three more common sleeping positions, the bra produces the following results:

On one's back: it prevents the breasts from moving to the sides, being this the most recommended position because it prevents the pressure of one breast on the other and, as a result, the stretching that they cause on the skin, protecting the neckline from the centre of the intermammary area.

Lateral decubitus position: Regardless of the side on which the user rests or lies down, right or left, the breast opposite the one that lays on the support surface, slides on the one that is resting on said surface, causing the stretching of the skin in the neckline, the intermammary area and the area of the skin of the breast in the opposite side on which it slides on the other, so that due to the configuration and design of the bra, it prevents the sliding of a breast on the other, upon these finding a support point.

On one's front: It reduces the pressure that is applied on the breasts as they are protected by the padding in the intermammary area, which is conveniently calculated in function of the depth of its internal development.

Figure 9:
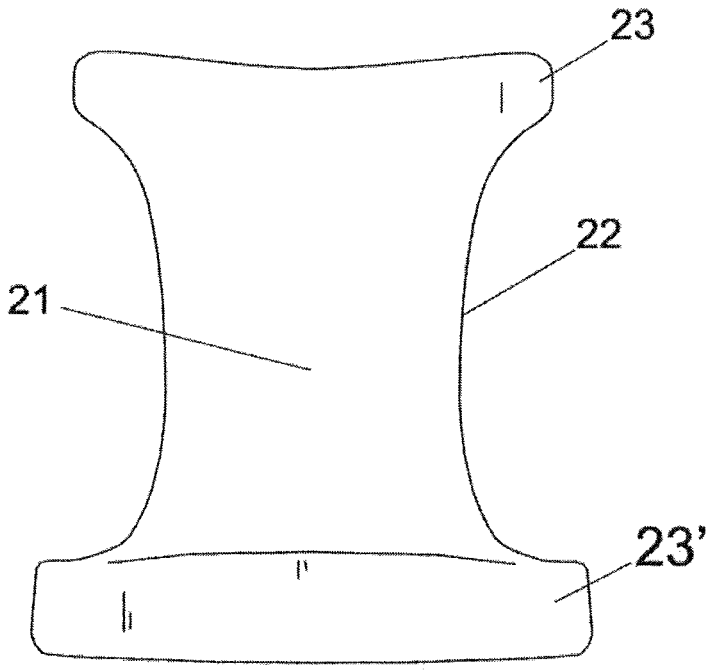
FIG. 9 Shows a front perspective view of the pad represented in FIGS. 7 and 8.

The bra described will be complemented with the pad represented in FIGS. 7, 8, 9 and 10, which is formed by an integral body (21) made of a spongy material, whose frontal aspect, as shown in FIG. 9, tends to be rectangular with two symmetrical, extensive, curved-concave lateral necklines (22), that are framed by small lateral extensions (23 and 23'), said integral body (21) having a front portion that corresponds to the reference itself (21), substantially flat crosswise and of a curved-convex profile vertically, adapting significantly to the anatomy of the woman's thorax.

In the rear portion, the aforementioned integral body (21) has a half, vertical protuberance (24) that has a round crest shape (25), framed by two curved-concave surfaces (26) corresponding in shape and dimensionally with the inner marginal area of the respective breasts of the woman.

Said integral body (1) is made of a spongy material and covered by a case or lining of a suitable material, and at its ends or lateral extensions (23 and 23') it will incorporate fastening means for the attachment and removal of shoulder straps to the pad itself, when the aforementioned pad wants to be attached to body of the user.

The pad described above, which can be used along with the bra or on its own, manages to fill the void that is created in the thoracic area, particularly in the intermammary area, preventing frontal or lateral pressures on the woman's body from causing deformations in her breasts that could cause any of the aforementioned problems.

The invention claimed is:

1. A brassiere for sleeping for the correction of sagging breasts and wrinkles, designed to provide rest for the breast and prevent and correct sagging of the breasts by restraint, as well as to prevent and correct the appearance of wrinkles and lines of expression in a woman's neckline and thorax area, the woman having shoulders, an intermammary area, a rear area of the neckline, a lower semi-perimeter of a contour of the breasts, and an inner marginal area of the breasts, the brassiere comprising: an integral body, having a front portion and a rear portion, said rear portion being a lateral extension of a sides of an armhole, fastening on a clasp on a lateral extension of an opposite side, the front portion having a lower elastic band as a support for the brassiere; characterized in that an ascending intermammary sector extends from the lower elastic band, forming a bridge that extends upwards until reaching the shoulders and neckline, while a central area of the lower elastic band is prolonged in a pair of sectors forming sides themselves; with the particularity that both the bridge and the sectors of the sides, are provided with padding of maximum thickness in the intermammary area and which progressively de-creases in width toward the rear area of the neckline, said padding extending in a portion until reaching the area corresponding to the lower semi-perimeter of the contour of the breasts in order to provide separation and support for said breasts.

2. A brassiere for sleeping for the correction of sagging breasts and wrinkles, according to claim 1, characterized in that the bridge of the front portion has curved-concave edges with an ascending projection toward the neckline and curved-concave edges downward, in connection with an inner edge of the sides, extending toward an inner lateral edge of each of said sides establishing a contour of corresponding cups of the bra.

3. A brassiere for sleeping for the correction of sagging breasts and wrinkles, according to claim 1, characterized in that the rear portion has elastic, cushioned and adjustable shoulder straps, which fasten in an upper area of the shoulders of the front portion of the bra itself.

4. A brassiere for sleeping for the correction of sagging breasts and wrinkles, according to claim 1, characterized in that it includes a lining made of microfiber, which extends on a surface of the front portion and rear portion, giving the bra its shape.

5. A brassiere for sleeping for the correction of sagging breasts and wrinkles, according to claim 1, further comprising an inter-pectoral pad formed by an integral body made of a spongy material, provided to fill a void created in the thoracic area, specifically in the woman's intermammary area, said body being properly molded to define a frontal face, of a curved-convex profile, parallel to the thorax of the user, with lateral curved-concave openings with a curvature in connection with an inner marginal area of the breasts, and which rear face has a sharp, vertically extended protuberance with round edges, for support on the thorax, with two sharply curved-concave parallel sides, for adapting to the inner marginal area of the breasts.

6. A brassiere for sleeping for the correction of sagging breasts and wrinkles, according to claim 5, characterized in that an integral body of the inter-pectoral pad is covered by a lining made of microfiber.

7. A brassiere for sleeping for the correction of sagging breasts and wrinkles, according to claim 5, characterized in that in connection with the lateral upper and lower extensions, defined by the lateral and curved-concave openings of the integral body of the pad, there are fastening means for the respective shoulder straps, which are removable from said pad.

* * * * *